US006102714A

United States Patent [19]

Oliphant et al.

[11] Patent Number: 6,102,714

[45] Date of Patent: Aug. 15, 2000

[54] ELECTRICAL CONNECTORS HAVING DUAL BIASED CONTACT PINS

[75] Inventors: David Oliphant, Salt Lake City; Thomas A. Johnson, Draper, both of Utah

[73] Assignee: 3Com Corporation, Santa Clara, Calif.

[21] Appl. No.: 09/271,620

[22] Filed: Mar. 17, 1999

Related U.S. Application Data

[63] Continuation-in-part of application No. 09/033,270, Mar. 2, 1998.

[51] Int. Cl.[7] ..... H01R 13/44; H01R 13/60

[52] U.S. Cl. ..... 439/131; 439/946

[58] Field of Search ..... 439/131, 946

[56] References Cited

U.S. PATENT DOCUMENTS

| | | | |
|---|---|---|---|
| 2,916,720 | 12/1959 | Steans . | |
| 4,241,974 | 12/1980 | Hardesty . | |
| 4,303,296 | 12/1981 | Spaulding . | |
| 4,407,559 | 10/1983 | Meyer . | |
| 4,428,636 | 1/1984 | Kam et al. . | |
| 4,710,136 | 12/1987 | Suzuki | 439/374 |
| 4,915,648 | 4/1990 | Takase et al. | 439/490 |
| 5,139,439 | 8/1993 | Shie | 439/359 |
| 5,183,404 | 2/1993 | Aldous et al. | 439/55 |
| 5,336,099 | 8/1994 | Aldous et al. | 439/131 |
| 5,338,210 | 8/1994 | Beckham et al. | 439/131 |
| 5,411,405 | 5/1994 | McDaniels et al. | 439/131 |
| 5,499,923 | 3/1996 | Archibald et al. | 439/26 |
| 5,505,633 | 4/1996 | Broadbent | 439/329 |
| 5,509,811 | 4/1996 | Hornic | 439/55 |
| 5,538,442 | 7/1996 | Okada | 439/676 |
| 5,547,401 | 8/1996 | Aldous et al. | 439/946 |
| 5,561,727 | 10/1996 | Akita et al. | 385/88 |
| 5,562,504 | 10/1996 | Moshayedi | 439/131 |
| 5,608,607 | 3/1997 | Dittmer | 361/686 |
| 5,634,802 | 6/1997 | Kerklaan | 439/131 |
| 5,660,568 | 8/1997 | Moshayedi | 439/654 |
| 5,667,395 | 9/1997 | Okada et al. | 439/131 |
| 5,679,013 | 10/1997 | Matsunaga et al. | 439/946 |
| 5,727,972 | 3/1998 | Aldous et al. | 439/655 |
| 5,773,332 | 6/1998 | Glad | 439/344 |

FOREIGN PATENT DOCUMENTS

| | | |
|---|---|---|
| 0 355 413 | of 0000 | Germany . |
| 58-34370 | of 0000 | Japan . |
| 61-256850 | 11/1986 | Japan . |
| WO 95/13633 | 5/1995 | WIPO . |

OTHER PUBLICATIONS

P.E. Knight and D.R. Smith, Electrical Connector for Flat Flexible Cable, Jun. 1982.

*Primary Examiner*—Neil Abrams
*Assistant Examiner*—Hae Moon Hyeon
*Attorney, Agent, or Firm*—Workman, Nydegger & Seeley

[57] ABSTRACT

An electrical coupling system includes a printed circuit board (PCB) that is selectively fixed to an electrical apparatus. The PCB has an elongated finger with a plurality of partially exposed contact lines formed thereon. A jack includes a slide plate having an aperture extending therethrough and a channel communicating with the aperture. The aperture is configured to receive a media plug. Mounted on the slide plate so as to be positioned over the channel is a pin block. The pin block has a plurality of elongated slots formed therein. The slots face the channel and are separated by insulating walls. Disposed within each of the elongated slots is a substantially S-shaped pin. Each pin has a tail end that is mounted to the pin block, a downwardly curved portion that extends within the channel, and an opposing lead end which is freely disposed within the aperture of the slide plate. The finger of the PCB is slidably received within the channel of the slide plate such that the jack can be selectively moved between an extended position and a retracted position. In the extended position the aperture is openly exposed to receive the media plug and the downwardly curved portion of each pin is biased against the exposed portion of a corresponding contact line on the PCB.

23 Claims, 9 Drawing Sheets

ELECTRICAL CONNECTORS HAVING DUAL BIASED CONTACT PINS

This application is a continuation-in-part of U.S. patent application Ser. No. 09/033,270, filed Mar. 2, 1998 is now pending which is incorporated herein by specific reference.

BACKGROUND OF THE INVENTION

1. The Field of the Invention

The present invention relates to electrical connectors for use with media plugs and, more specifically, sliding pin assemblies configured to establish electrical communication between a media plug and a PCB.

2. Present State of the Art

Electrical apparatus, such as personal computers, cellular telephones, and personal information managers (PIMs), are becoming increasingly dependent upon their ability to electrically communicate or share information with other electrical apparatus. To facilitate this electrical communication, a variety of different types of electrical couplers have been developed. An electrical coupler includes a plug and a corresponding jack or connector. The jack typically includes an aperture or socket configured to receive the plug so as to establish electrical communication therebetween.

Select types of electrical couplers have been designed for use with PC cards. A PC card is a small thin card typically having a standard size. A first type of connector is formed at one end of the PC card and is configured to couple with the electrical apparatus. A second type of connector or jack is formed at the opposing end of the PC card and is configured to couple with a desired outside line such as a telephone line or a network line. Disposed within the PC card is a circuit board providing the necessary circuitry to perform one or more intended functions. For example, in one type of PC card, the circuit board comprises a modem which enables the electrical apparatus to receive and transmit information over telephone lines. In another PC card, the circuit board enables the electrical apparatus to receive and transmit information with a network system over a network cable.

One conventional type of jack used for connecting a PC card to an exterior line comprises a thin plate which is slidably mounted to the PC card. The plate has a top surface with an aperture formed therein. A plurality of short contact pins are rigidly mounted to the thin plate. Each contact pin has a first end that is freely exposed within the aperture and an opposed second end mounted to the plate. A flexible wire ribbon has a first end that is soldered to the second end of the contact pins and an opposing second end that is soldered to contacts on the circuit board within the PC card.

The thin plate can selectively slide between an extended position and a retracted position. In the extended position, the aperture is exposed such that a corresponding plug, for example an RJ-11, commonly referred to as a telephone plug, can be received therein. The plug pushes against the contact pins so as to establish electrical contact therewith. As a result, electrical communication is established from the plug, through the contact pins and flexible wire ribbon, to the circuit board. When not in use, the thin plate is retracted by sliding back within the PC card such that the aperture is not exposed. The ability to repeatedly slide the plate between the extended and retracted position while maintaining electrical communication between the pins and the circuit board is attributed to the flexible wire ribbon. That is, the wire ribbon freely bends or folds as the plate is retracted and then unfolds as the plate is extended.

Although effective in establishing electrical communication between a plug and a circuit board of a PC card, the above described sliding jack has several drawbacks. For example, repeated movement of the plate between the retracted and extended position produces stresses on the flexible wire ribbon and its soldered contacts. These stresses eventually result in fatigue failure of the wire ribbon and/or the solder contact. Moreover, during the manufacturing process, soldering requires high temperatures which potentially serve to deform the materials used in the flexible wire ribbon. Often these materials are plastic and can be catastrophically destroyed. Additionally, during the solder manufacturing process, too much solder applied at areas of electrical connections can cause the solder to spread and potentially cause electrical shorts.

Furthermore, since the slidable plate is fixedly attached to the circuit board by the flexible wire ribbon, it is difficult if not impossible to replace or repair the plate or pins. Thus if any element of the electrical coupling system is damaged, either the PC card must be returned to the manufacturer for repair, or a new PC card must be purchased.

Still other limitations exist within the manufacturing process. The flexible wire ribbon is positioned on the circuit board by techniques commonly known as "pick-and-place." Although generally effective, the pick-and-place process often "loses" the flexible wire ribbon as it is being positioned on the PCB. This losing then disrupts the manufacturing line, especially automated ones. It can also cause the flexible wire ribbon to be incorrectly positioned on the PCB. Moreover, pick-and-place may overstress the wires or conductors within the ribbon when maneuvering. This can potentially causes failure of the conductors.

Another inherent limitation is the spatial arrangement that must exist within the communications card to allow the sliding plate to freely move without constriction from the flexible wire ribbon. That is, a relatively large free area must be formed within the card to enable the wire ribbon to freely move and flex. This free area limits the size of the circuit board and the number of electrical components that can be positioned thereon.

Another problem associated with conventional retractable jacks relates to the pin configuration. That is, the second end of each pin is rigidly secured to the plate so as to suspend the opposing free end within the aperture. Insertion of the plug downwardly bends the pins. The pins then resiliently flex back to their original configuration upon removal of the plug. Repeated insertion and removal of the plug can produce localized stresses within the pins and eventually result in their fatigue failure. Furthermore, the pins can be easily bent beyond their elastic limit. This permanent bending of the pins can prevent them from biasing against the plug.

OBJECTS AND BRIEF SUMMARY OF THE INVENTION

Accordingly, it is an object of the present invention to provide improved connectors for facilitating electrical communication between a media plug and an electrical apparatus.

Another object of the present invention is to provide connectors as above that substantially eliminate reliance upon solder joints and flexible wire ribbons.

It is another object of the present invention to provide improved connectors that are easily manufactured and can be positioned by pick-and-place manufacturing.

Still another object of the present invention is to provide connectors as above wherein the system includes a retractable slide plate that can be repeatedly removed and replaced without damage to the system.

It is a further object of the present invention to provide connectors that consume less physical space.

It is still a further object of the present invention to provide improved connectors that substantially eliminate the possibility of electrically shorting components.

Finally, another object of the present invention is to provide improved connectors having contact pins wherein the potential for localized fatigue and bending beyond an elastic point is minimized.

To achieve the foregoing and other objectives, and in accordance with the invention as embodied and broadly described herein, a jack is provided for facilitating electrical communication between a media plug, such as an RJ-type plug, and a printed circuit board (PCB) or other similar type of rigid member disposed on an electrical apparatus. Examples of electrical apparatus include lap top computer, personal information manager, or cellular telephone. The PCB has an elongated finger that extends to a free distal end. A plurality of contact lines are formed on the top surface of the finger. The portion of the contact lines at the distal end of the PCB finger are openly exposed while the remainder of the contact lines are covered by an insulating layer.

The jack is slidably mounted on the PCB finger. More specifically, the jack includes a slide plate having an aperture extending therethrough and a channel communicating with the aperture. Mounted on the slide plate so as to be positioned over the channel is a pin block. The pin block has a plurality of elongated slots formed therein. The slots face the channel and are separated by insulating walls. Disposed within each of the elongated slots is a substantially S-shaped pin. Each pin has a tail end that is mounted to the pin block, a downwardly curved portion that extends within the channel, and an opposing lead end which is freely disposed within the aperture of the slide plate.

During assembly, the finger of the PCB is slidably received within the channel of the slide plate such that the jack can be selectively moved between an extended position on the electrical apparatus and a retracted position within the electrical apparatus. In the retracted position, the slide plate is slid along PCB finger such that the aperture is substantially enclosed within the electrical apparatus. In this position, the downwardly curved portion of each pin is positioned over an insulated portion of the contact lines on the PCB. As a result, each contact pin is insulated from electrical communication with a corresponding contact line.

In the extended position, the slide plate is advanced outward along the PCB finger so as to openly expose the aperture. In this position, the downwardly curved portion of each pin is biased against the exposed portion of a corresponding contact line on the PCB. As a result, each pin is in electrical communication with the corresponding contact line. In this extended position, the media plug is selectively received within the aperture so as to bias in electrical communication against the lead end of each pin. As a result, electrical communication is facilitated between the media plug and corresponding contact lines on the PCB through the pins. In turn, the contact lines can be placed in electrical communication with the electrical apparatus in any conventional manner.

The inventive jack and related pins have a variety of advantages over prior art systems. For example, as a result of the pins facilitating electrical communication with the PCB by biased rather then fixed engagement, the required use of the flexible wire ribbon is eliminated. The elimination of the flexible wire ribbon not only greatly simplifies the manufacturing process but also eliminates problems associated with soldering and eliminates failures due to fatigue and ware of the flexible wire and soldered contacts. In addition, by removing the flexible wire ribbon, the jack as set forth herein can be repeatedly separated from the system and selectively reattached by an end user without damage to the system.

Furthermore, the unique configuration and use of the pins enables the pins to have a relatively long length. This long length enables the pins to more evenly distribute stresses along the length of the pin. As a result, the inventive pins experience less localized fatigue and have a reduced potential for bending beyond their point of elastic deformation.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
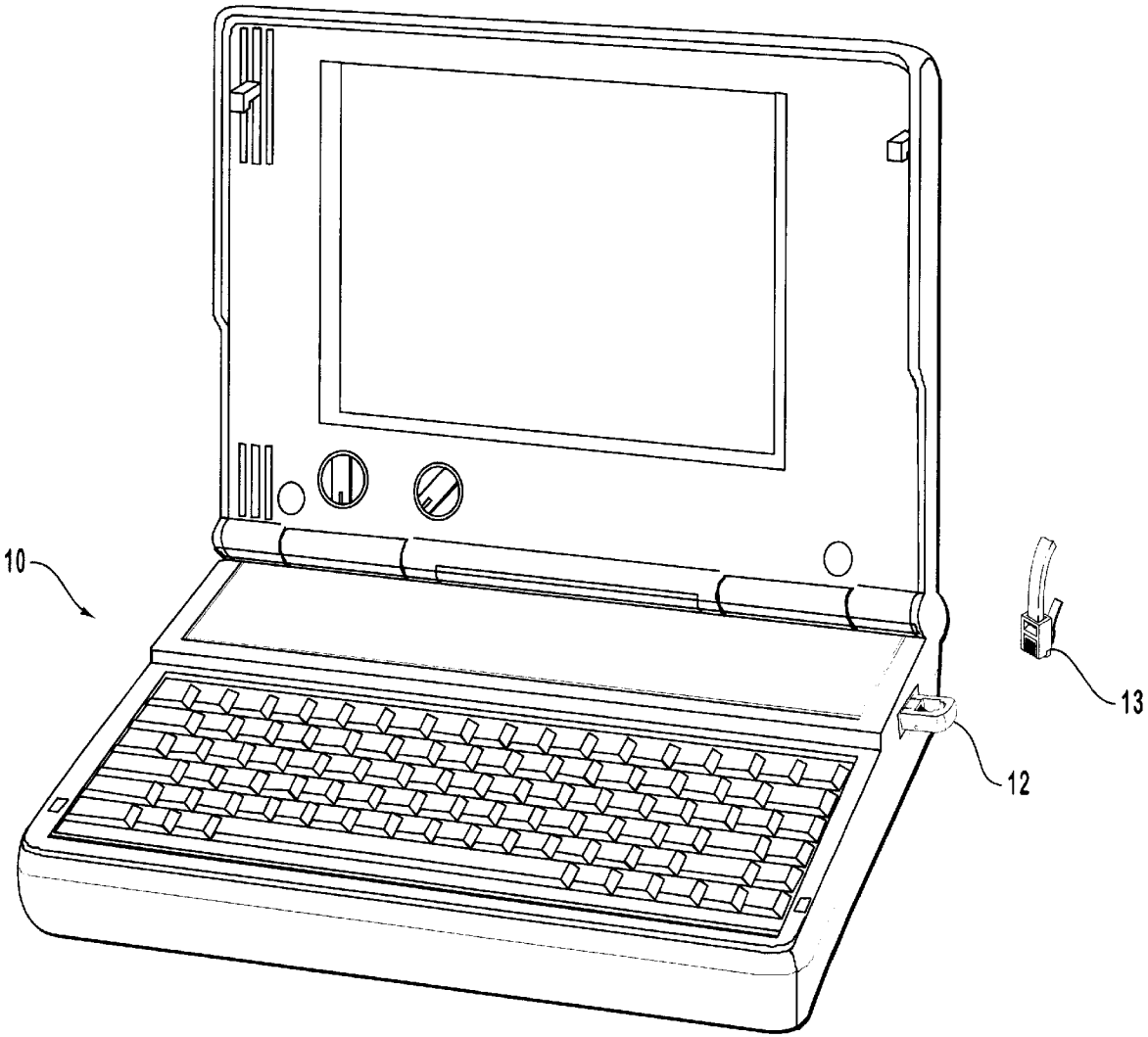
FIG. 1 is a perspective view of a laptop computer having one embodiment of an inventive modular connector attached thereto.

Depicted in FIG. 1 is a lap top computer 10 having mounted thereon one embodiment of a physical/electrical modular connector 12 incorporating novel features of the present invention. Modular connector 12 is configured to both physically and electrically couple a media plug 13 to a desired electrical apparatus such as computer 10. As used in the specification and appended claims, the term "media plug" is broadly intended to include RJ-type plugs such as the RJ-11, RJ-45, and other RJ-types plugs which currently exist or will be developed in the future under new standards. The term "media plug" also includes those plugs having physical attributes that fall under F.C.C. Part 68, Subpart F. Although modular connector 12 is shown mounted on lap top computer 10, modular connect 12 can similarly be mounted on virtually any type of electrical apparatus that requires electrical coupling with a cable such as a telephone line or network line. Examples of such electrical apparatus include cellular phones, pagers, personal information managers (PIM), PCMCIA cards, network cards, notebook computers, personal computers, diagnostic equipment, and other hand operated electrical devices.

Figure 2:
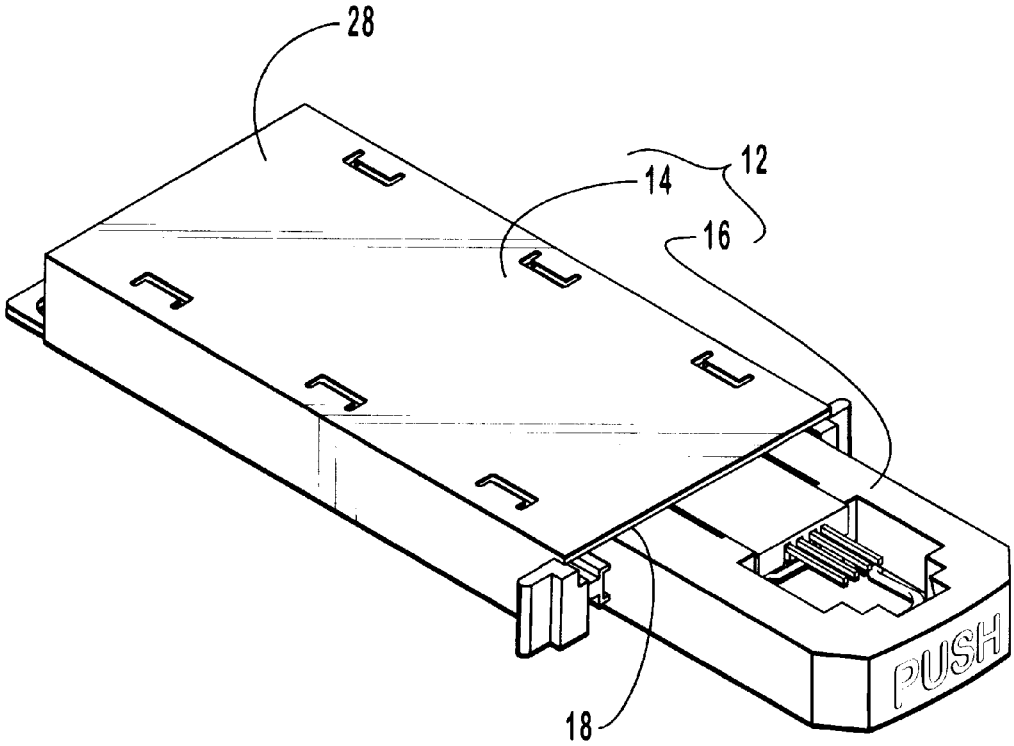
FIG. 2 is a perspective view of the modular connector shown in FIG. 1.

Depicted in FIG. 2, modular connect 12 comprises a housing 14 having a jack 16 retractably mounted within a compartment 18 thereof. One of the unique features of modular connect 12 is that it can be easily removed or attached to a variety of different electrical apparatus. Prior art jacks were integrally constructed with a corresponding electrical apparatus, thereby making it difficult if not impossible to add or remove a jack. In contrast, as discussed later in greater detail, as a result of connector 12 being modular, housing 14 can be easily mounted or removed from a printed circuit board (PCB) or other structural feature of an electrical apparatus.

Figure 3:
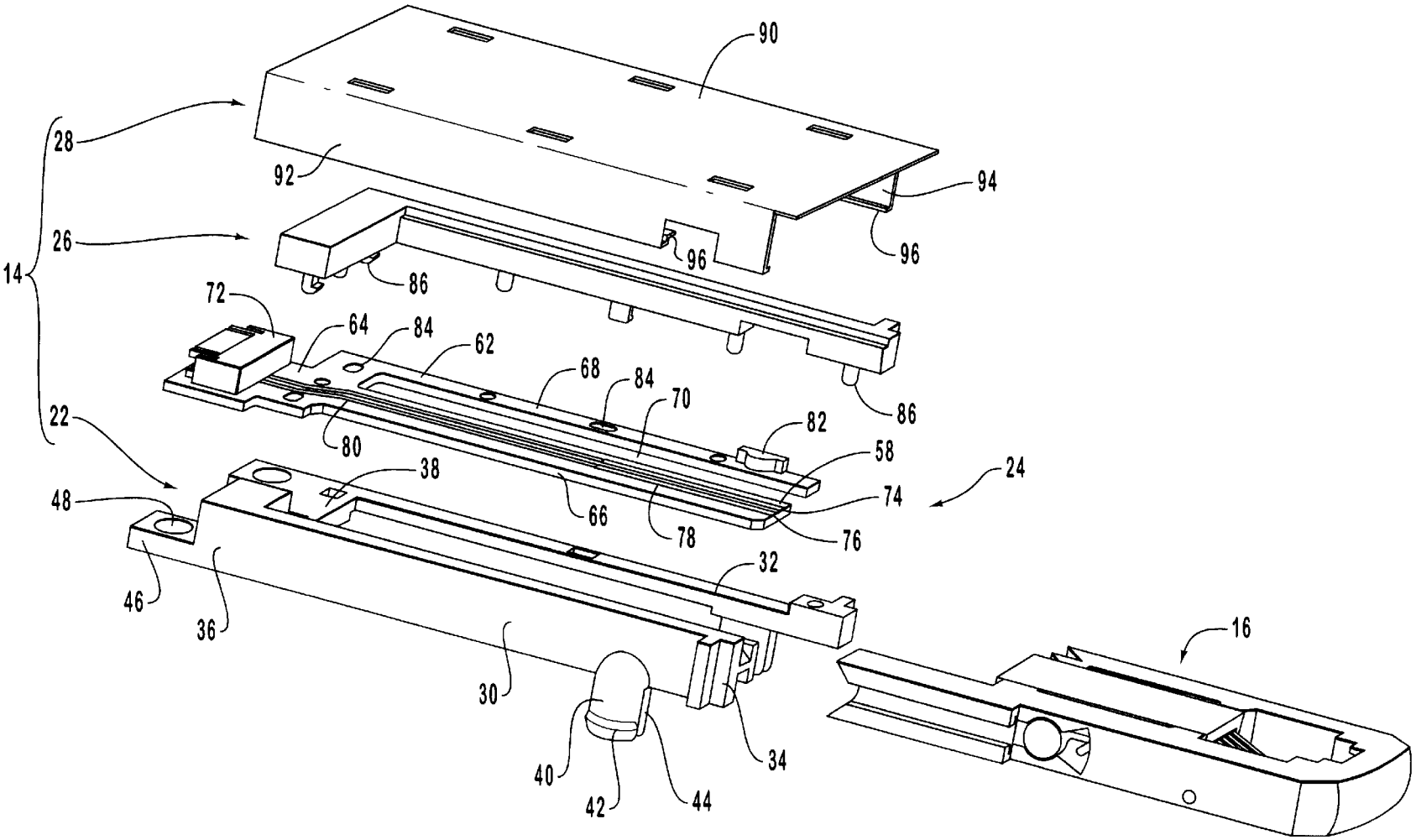
FIG. 3 is an exploded view of the modular connector shown in FIG. 2.
Figure 4:
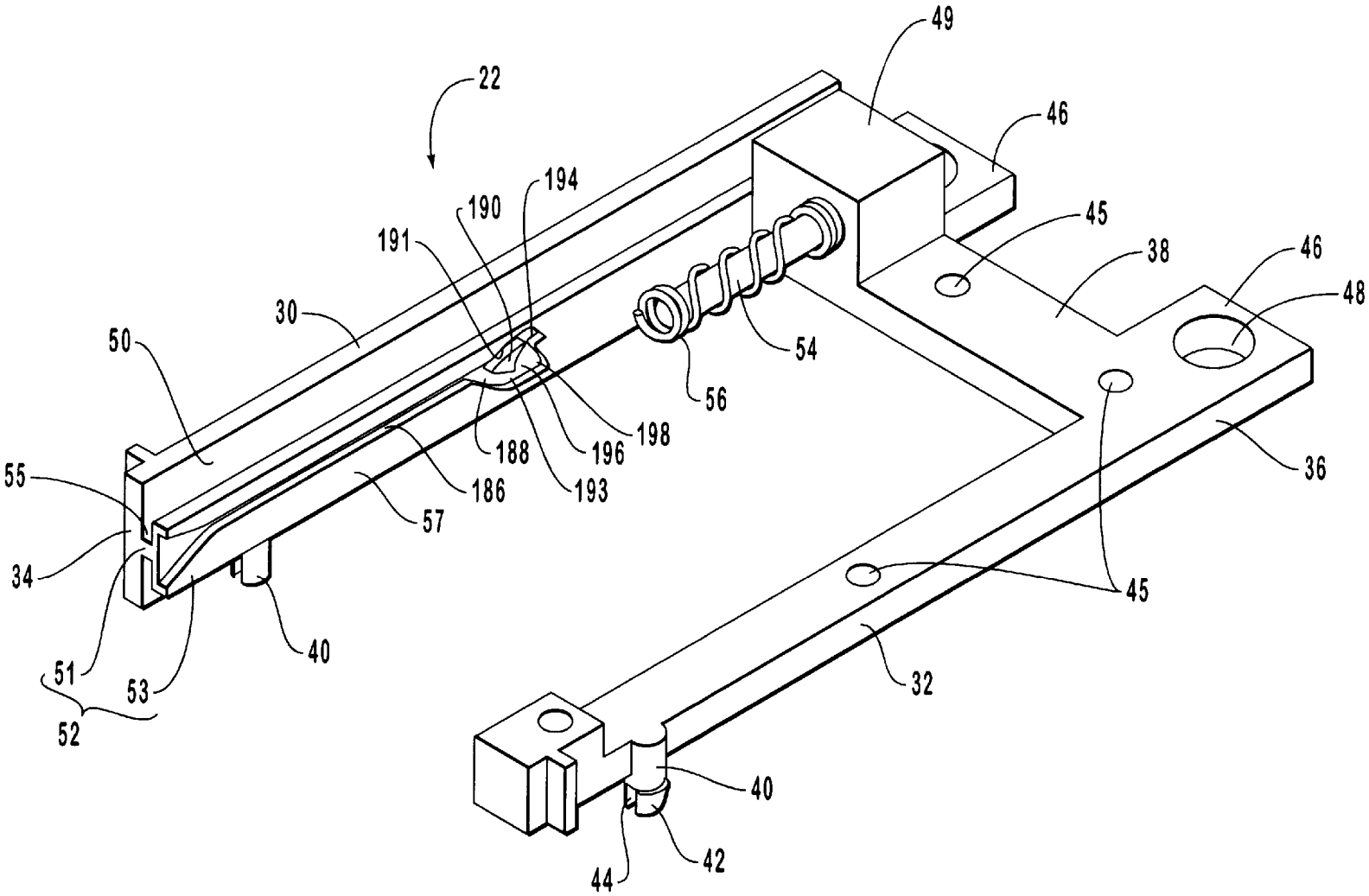
FIG. 4 is a perspective view of the frame of the modular connector shown in FIG. 3.

Depicted in FIG. 3, housing 14 comprises a frame 22, a retainer 26, and a cover 28. Mounted to housing 14 is a board assembly 24. As depicted in FIGS. 3 and 4, frame 22 has a substantially U-shaped configuration which includes a first arm 30 and a spaced apart second arm 32 each in substantially parallel alignment. Each arm 30 and 32 extends between a free first end 34 and an opposing second end 36. Extending between second ends 36 of arms 30 and 32 is a cross member 38. A plurality of retention holes 45 extend through second arm 32 and cross member 38.

In one embodiment of the present invention, means are provided for securing housing 14 to a structure. By way of example and not by limitation, projecting from each arm 30 and 32 adjacent to first end 34 is a post 40. Radially outwardly projecting from post 40 is a barb 42. Transversely extending through the end of post 40 is slot 44. Accordingly, by pushing post 40 through an aperture, such as on a PCB, barb 42 is free to compress and then expand on the opposing side of the PCB, thereby securing frame 22 thereto. As an alternative to the means, projecting from cross member 38 are a pair of spaced apart tabs 46. Each tab 46 has an aperture 48 extending therethrough. Each aperture 48 is configured to receive a post, such as may be projecting from a PCB or other structure. The present invention also envisions that there are a variety of different tongue and groove or other types of catches known to those skilled in the art that can be used for securing frame 22 to a structure.

First arm 30 has an inside face 50 with a substantially T-shaped member 52 inwardly projecting therefrom. Member 52 comprises a narrow elongated stem 51 projecting from inside face 50 along the length thereof and an enlarged rail 53 formed at the end of stem 51 and also extending substantially the length of first arm 30. Rail 53 has an exposed inside face 57. Formed between rail 53 and first arm 30 on opposing sides of stem 51 are a pair of narrow tracks 55. Mounted on cross member 38 adjacent to first arm 30 is a block 49. Projecting from block 49 in substantially parallel alignment with first and second arms 30 and 32 is a post 54 having a spring 56 mounted thereon. Rail 53 and spring 56 interact with jack 16 and will be discussed later therewith.

Depicted in FIG. 3, board assembly 24 comprises a PCB 62 including a base portion 64 and an elongated center finger 66 projecting from base portion 64 to a free distal end 58. Also projecting from base portion 64 and substantially in parallel alignment with center finger 66 is an elongated side finger 68. An elongated slot 70 extends between fingers 66 and 68. Disposed on base portion 64 is an electrical connector 72. In one embodiment, connector 72 comprises a zero-insertion-force (ZIF) connector available from 3Com. In alternative embodiments, connector 72 can comprise any of a plurality of different types of connectors for connecting either a flexible wire or a rigid plug to board assembly 24. In yet other embodiments, fixed pins can project from PCB 62 for electrical coupling with an electrical apparatus upon attachment of housing 14 thereto.

Formed on the top surface of PCB 62 are a pair of contact lines 74 and 76. Contact lines 74 and 76 extend from connector 72 to distal end 58 of center finger 66. Contact lines 74 and 76 include an exposed portion 78 wherein contact lines 74 and 76 are in substantially parallel alignment and are freely exposed on the top surface of center fingers 66. Contact lines 74 and 76 also include a covered portion 80 which is covered or otherwise insulated on PCB 62 and extends from exposed portion 78 to connector 72. In alternative embodiment, any number of contact lines can be formed on PCB 62. The number of contact lines generally depends on the intended use of modular connector 12 and the type of media plug with which it will interact. In alternative embodiments, board assembly 24 can be comprised of any board like member on which contact lines 74 and 76 can be formed independent of the method.

In one embodiment, a light source 82, such as a light emitting diode, an incandescent light, or the like, is mounted at the distal end of side finger 68. Contact lines can extend from connector 72 to light sources 82 on PCB 62 for energizing. Formed on base portion 64 and side finger 68 are a plurality of retention holes 84. During assembly, board assembly 24 is disposed on frame 22 such that base portion 64 rests on cross member 38, side finger 68 rests on second arm 32, and center finger 66 is freely disposed between first arm 30 and second arm 32. In this position, retention holes 84 on board assembly 24 are aligned with retention holes 45 on frame 22.

Retainer 26 has a substantially L-shaped configuration having a plurality of locking posts 86 projecting from the bottom surface thereof. Retainer 26 is configured to be disposed on top of base portion 64 and side finger 68 of PCB 62 such that locking posts 86 pass through corresponding retention holes 84 and retention holes 45, thereby securing board assembly 24 to frame 22.

Cover 28 comprises a top wall 90 having a pair of opposing side walls 92 and 94 downwardly projecting from the sides thereof. Inwardly projecting from the free end of each side arm 92 and 94 is a retention lip 96. As depicted in FIG. 2, cover 28 is configured to be positioned over the assembled frame 22, board assembly 24, and retainer 26. Retention lips 96 bias against the bottom surface of frame 22 so as to retain cover 28 in position. In one embodiment, cover 28 is comprised of a thin sheet of stainless steel. In alternative embodiments, cover 28 can be comprised of other metallic or insulating materials.

Figures 5, 6:
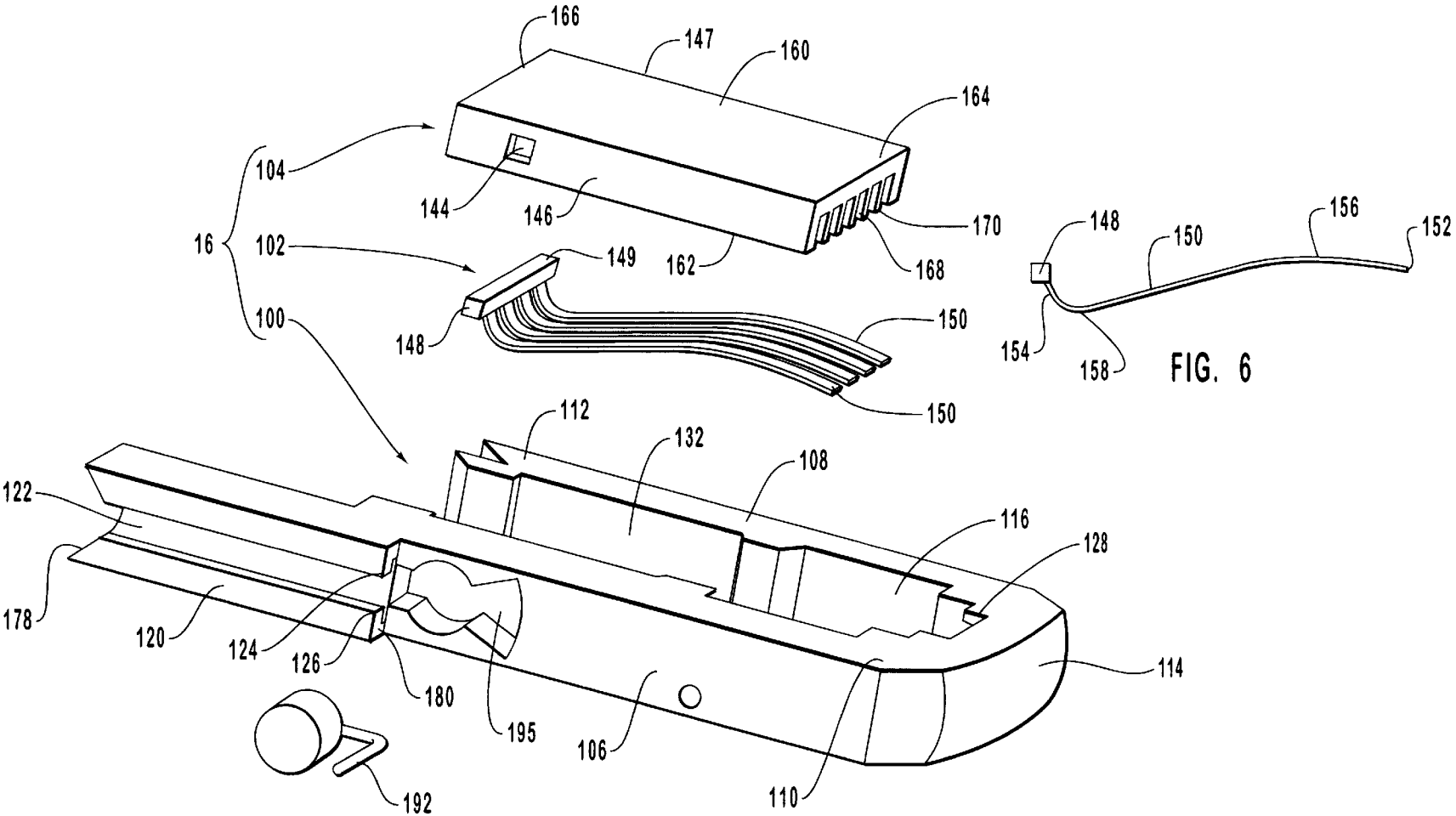
FIG. 5 is an exploded view of the jack of the modular connector shown in FIG. 3.
FIG. 6 is a side view of the pin assembly of the jack shown in FIG. 5.
Figure 9A:
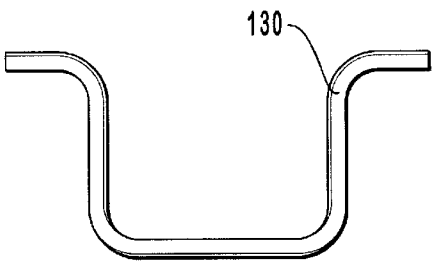
FIG. 9A is a front view of the U-shape saddle depicted in FIG. 9.
Figure 9:
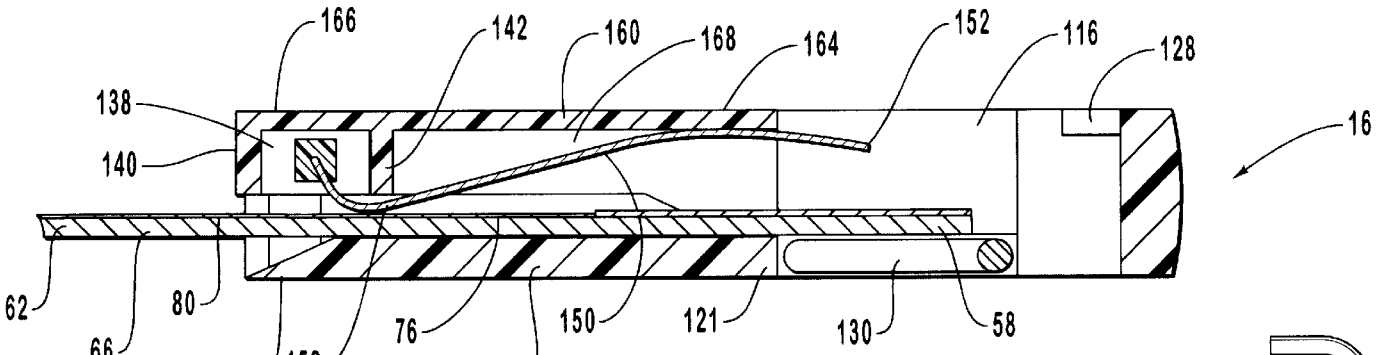
FIG. 9 is a cross sectional side view of the jack shown in FIG. 7 in a retracted position.

Depicted in FIG. 5, jack 16 comprises a slide plate 100 having a pin assembly 102 secured thereto by a pin block 104. Slide plate 100 comprises a pair of spaced apart substantially parallel side walls 106 and 108. Each side wall 106 and 108 extends between a front end 110 and an opposing back end 112. Extending between opposing front ends 110 is a front wall 114. As depicted in FIGS. 5 and 9, extending through slide plate 100 between side walls 106 and 108 adjacent to front wall 14 is an aperture 116. Aperture 116 is configured to receive media plug 13. In the embodiment depicted, aperture 116 extends through slide plate 100 at an angle orthogonal to the plane of slide plate 100. In alternative embodiment, aperture 116 can be sloped at an angle less than 90° relative to the plane of slide plate 100.

In one embodiment of the present invention, means are provided for releasably securing media plug 13 within aperture 116. By way of example and not by limitation, projecting into aperture 116 from front wall 14 is a catch lip 128. Catch lip 128 is configured to engage the prong on a conventional RJ-11 plug so as to mechanically retain the plug within aperture 116. Alternative embodiments for the orientation of aperture 116 and for the releasably securing means are disclosed in U.S. Pat. No. 5,547,401, filed Aug. 16, 1994 (hereinafter "the '401 patent"), and U.S. patent application Ser. No. 08/976,819, filed Nov. 24, 1997 (hereinafter "the '819 application"), which are incorporated herein by specific reference.

The present invention also includes means for preventing the passage of media plug 13 completely through aperture 116. By way of example and not by limitation, depicted in FIGS. 9 and 9*a*, rotatably extending between side walls 106 and 108 in alignment with aperture 116 is a substantially U-shaped saddle 130. Saddle 130 acts as a stop to prevent media plug 13 from passing too far through aperture 116. Examples of other embodiments of the means for preventing the passage of media plug 13 include an elastic member, ledge, or spring disposed below aperture 116. Examples of these and other embodiments of the means for preventing the passage of media plug 13 are disclosed in the '401 patent and '819 application which were previously incorporated herein by specific reference.

As also depicted in FIG. 9, a floor 118 extends between side walls 106 and 108 adjacent to aperture 116. Floor 118 has a tapered back end 119 and an opposing front end 121 bounding aperture 116. As better seen in FIG. 5, floor 118 and side walls 106 and 108 bound a channel 132 which is aligned with and communicates with aperture 116. In one embodiment, slide plate 100 can be comprised of an opaque material. In yet another embodiment, slide plate 100 can be manufactured from a translucent material such that light source 82 can illuminate slide plate 100. An example of the configuration of slide plate 100 for illumination by light source 82 is disclosed in U.S. patent application Ser. No. 09/187,175, filed Nov. 5, 1998 which is incorporated herein by specific reference.

Pin assembly 102 comprises a plurality of substantially S-shaped pins 150 that are coupled in substantially parallel alignment by a yoke block 148. The term "S-shaped" is broadly intended to includes the shape of any pins wherein opposing ends are curved in opposing directions. As depicted in FIG. 6, each pin 150 extends from a lead end 152 to an opposing tail end 154. The distance between lead end 152 and yoke block 148 along ping 150 is typically in a range between about 14 mm to about 25 mm, with about 17 mm to about 22 mm being more preferred. Formed adjacent to lead end 152 is an upwardly curved portion 156. In alternative embodiments, curved portion 156 can be straight. Disposed adjacent to tail end 154 is a downwardly curved portion 158. Tail end 154 of each pin 150 is secured together by yoke block 148. In the embodiment depicted, yoke block 148 extends between opposing ends 149 and has a substantially square transverse cross section.

Pin block 104 has a shallow box-like configuration having a flat top surface 160 and an opposing bottom surface 162 each extending between a front end 164 and an opposing back end 166. Pin block 104 also has opposing side walls 146 and 147. Formed on bottom surface 162 at front end 164 are a plurality of elongated slots 168 separated by insulating walls 170. As better seen in FIG. 9, a back wall 140 and a boundary wall 142 transversely extend between opposing side wall 146 and 147 at back end 166. Back wall 140 and boundary wall 142 bound a compartment 138 therebetween. Returning back to FIG. 5, an aperture 144 extends through each side wall 146 and 147 so as to communicate with compartment 138.

Figure 7:
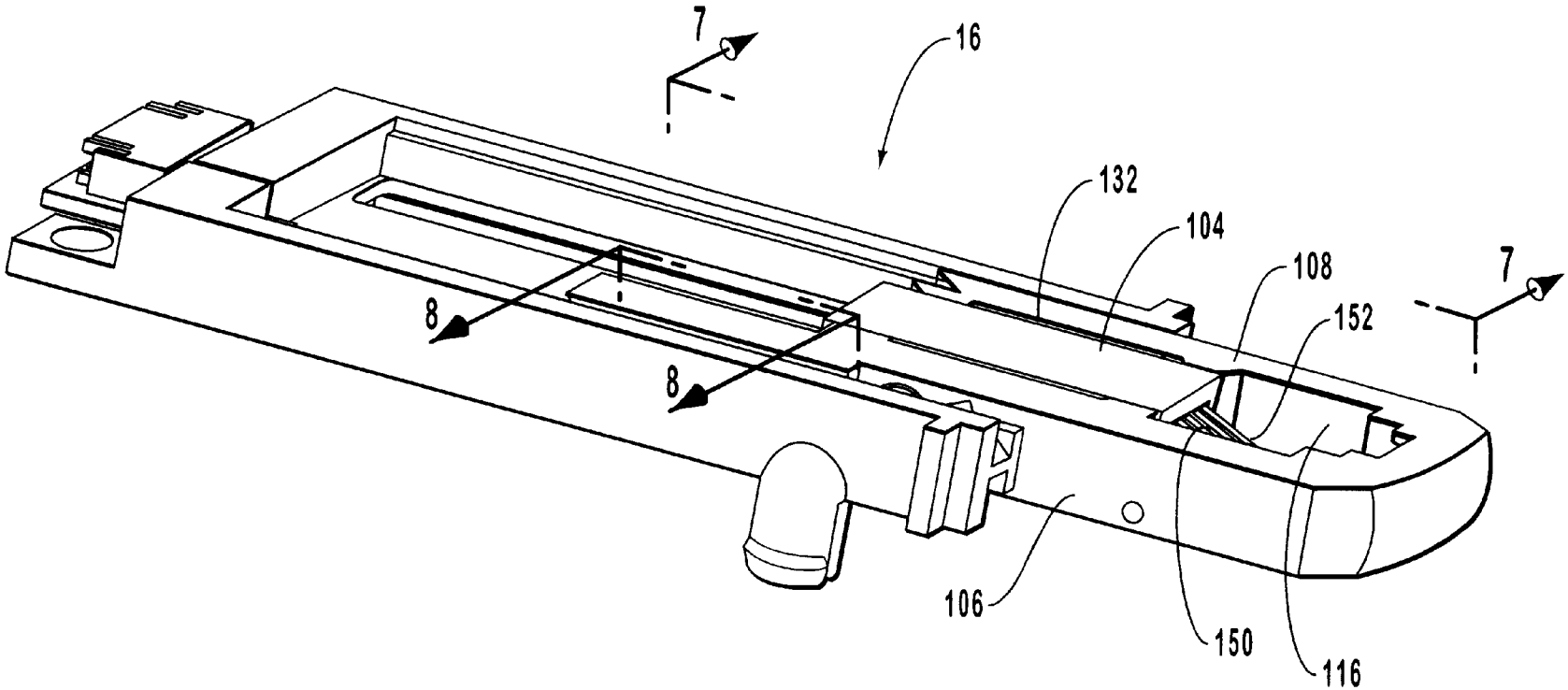
FIG. 7 is a perspective view of the modular connector shown in FIG. 2 with the cover removed therefrom.

During assembly, opposing ends 149 of yoke block 148 are snap fit within apertures 144 so as to secure pin assembly 102 to pin block 104. In the embodiment depicted, apertures 144 have a substantially square cross section that is complementary to the transverse cross section of yoke block 148. As such, yoke block 148 is prevented from rotating one it is received within apertures 144. In this position, each pin 150 is received within a corresponding slot 168 with lead end 152 freely projecting past front end 164 of pin block 104. Insulating walls 170 prevent contact between pins 150. Pin block 104 is then secured between opposing side walls 106 and 108 of slide plate 100 as depicted in FIG. 7. In this configuration, pins 150 are disposed within channel 132 while lead end 152 of each pin 150 is vertically disposed within aperture 116.

In one embodiment of the present invention, means are provided for preventing annular rotation of tail end 154 of pin 150 relative to pin block 104. By way of example and not by limitation, as a result of yoke block 148 having a transverse square cross section that is complementary to apertures 144 in pin block 104, tail end 154 of each pin 150 is prevented from annular rotation relative to pin block 104 when opposing ends of yoke block 148 are received within apertures 144. Other polygonal shapes such as a triangle, rectangle, pentagon, or the like, would also served to perform the same function.

Figure 11:
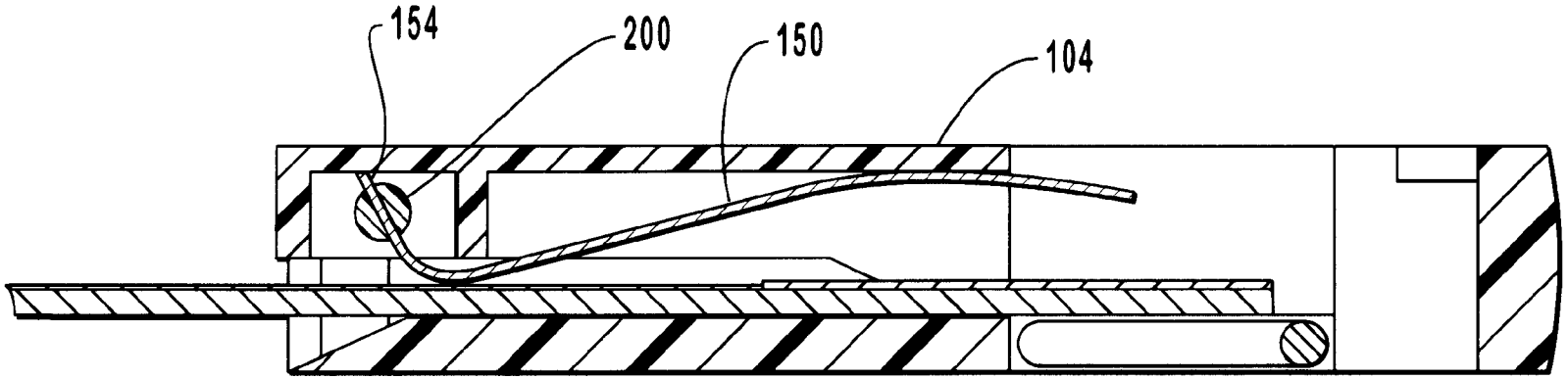
FIG. 11 is a cross sectional side view of an alternative embodiment of the jack shown in FIG. 10.

In yet another alternative embodiment, as depicted in FIG. 11, a yoke block 200 is provided having a substantially cylindrical shape. Apertures 144 on pin block 104 can have a circular, square, or any other configuration that will receive the opposing ends of yoke block 200. In this embodiment, however, pin 150 is configured such that when yoke block 200 is received within apertures 144, tail end 154 of pin 150 is biased against pin block 104 so as to prevent annular rotation of pin 150 around yoke block 200.

In other embodiments, pins 150 can be configured to rotate relative to pin block 104. For example, tail end 154 of pin 150, as shown in FIG. 11, can also be configured to terminate within cylindrical yoke block 200. By forming apertures 144 such that the opposing ends of yoke block 200 can freely rotate therein, pins 150 are free to rotate about an axis extending through cylindrical yoke block 200.

Once jack 16 is assembled, it can be removably attached to housing 14 as shown in FIG. 7. Returning back to FIG. 5, rearwardly projecting from side wall 106 of slide plate 100 is an elongated slide arm 120. Slide arm 120 has a substantially C-shaped transverse cross section that terminates at a pair of inwardly facing rails 124 and 126. Each rail 124 and 126 extends between an inwardly tapered end 178 and an opposing flat end 180. Slide arm 120 is configured such that rails 124 and 126 can be selectively received within opposing tracks 55 on frame 22. Slide plate 100 can thus selectively extend and retract by sliding along the length of tracks 55.

Figure 8:
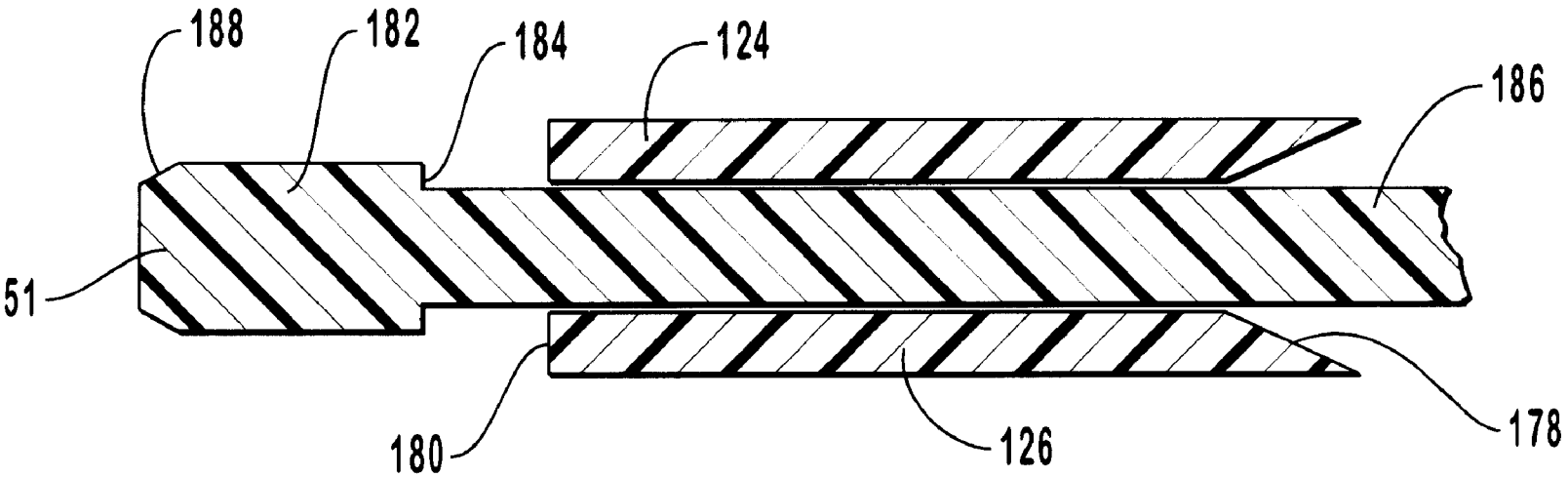
FIG. 8 is a cross sectional side view of the modular connector shown in FIG. 7 taken along section lines 8—8.

In one embodiment of the present invention, means are provided for releasably securing jack 16 to housing 14. By way of example and not by limitation, depicted in FIG. 8, elongated stem 51 of frame 22 includes an enlarged head 182 that tapers at an abrupt shoulder 184 to an elongated narrow body 186. The front end of head 182 has tapered shoulder 188 formed thereon. During assembly, tapered end 178 of rails 124 and 126 are pushed against tapered shoulder 188 of stem 51. As a result of the complementary tapers and the applied force, rails 124 and 126 resiliently expand enabling rails 124 and 126 to pass over head 182 and then snap back over narrow body 186. Rails 124 and 126 can then freely slid back and forth along narrow body 186 without disengaging from frame 22.

Contact between flat end 180 of rails 124 and 126 and shoulder 184 of stem 51 prevents jack 16 from accidentally sliding off of stem 51. The present system is designed, however, such that when sufficient pulling force is applied to jack 16 relative to housing 14, rails 124 and 126 spread sufficiently far apart to allow rails 124 and 126 to pass over head 182, thereby permitting removal of jack 16 from housing 14 without damaging either component. When desired, jack 16 can simple be replaced as discussed above. The amount of force required to remove jack 16 can be varied by varying the design. That is, the desired force is decreased by narrowing the width of head 182 or increasing the gap between rails 124 and 126. Furthermore, the force can be decreased by tapering shoulder 184 and/or end 180 of rails 124 and 126.

With jack 16 attached to housing 14 as discussed above, jack 16 can be selectively moved between a retracted position wherein jack 16 is slid back into housing 14 so as to be substantially enclosed therein and an extended position wherein the front end of jack 16 projects out of housing 14 such that aperture 116 is openly exposed. In one embodiment, means are provided for biasing jack 16 into the extended position. By way of example and not by limitation, depicted in FIGS. 4 and 5, spring 56 mounted on post 54 of frame 22 is received within channel 122 of elongated side arm 120 so as to bias against wall 106 of slide plate 100. As a result, spring 56 continually biases jack 16 into the extended position.

In alternative embodiments, it is envisioned that spring 56 can be placed at different locations to bias against jack 16. Furthermore, spring 56 can be replaced with other conventional types of springs such as a leaf spring. Examples of alternative embodiments of the means for biasing jack 16 outward are disclosed in the '401 patent and '819 application which were previously incorporated herein by specific reference.

The present invention also includes means for selectively retaining jack 16 in the retracted position. By way of example and not by limitation, depicted in FIGS. 4 and 5, inside face 57 on rail 53 of frame 22 has a channel 186 recessed therein. A substantially heart-shaped groove 188 having a substantially heart-shaped guide 190 disposed in the center thereof is formed at the end of channel 186. A pin 192 is rotatably disposed within a recess 195 formed on the outside face of side arm 106 of slide plate 100. The free end of pin 192 is configured to be received within channel 186 when jack 16 is slidably attached to housing 14 as discussed above. As jack 16 is manually retracted or pushed within housing 14, pin 192 travels along channel 186 into groove 188. As a result of channel 186 being slightly offset above guide 190, pin 192 first travels in an upper side channel 191 which curves around to a first alcove 194. Alcove 194 stops the progression of pin 192 and thus jack 16. As jack 16 is manually released, spring 56 produces a biasing outward force on jack 16 causing pin 192 to move into a saddle 196 formed on guide 190. The contact between pin 192 and saddle 196 prevents jack 16, which is continually urged by spring 56, from automatically advancing out into the extended position.

To move jack 16 back into the extended position, jack 16 is manually pushed slightly into housing 14. The configuration of groove 188 causes pin 192 to move into an outwardly curving second alcove 198. As jack 16 is manually released, pin 192 slides down a lower side channel 193 back into main channel 186, thereby allowing jack 16 to freely slide outward into the extended position. The above process can be repeated to selectively move jack 16 between the retracted and extended position. Alternative embodiments of the means for selectively retaining are disclosed in the '401 patent and '819 application which were previously incorporated herein by specific reference.

Figure 10:
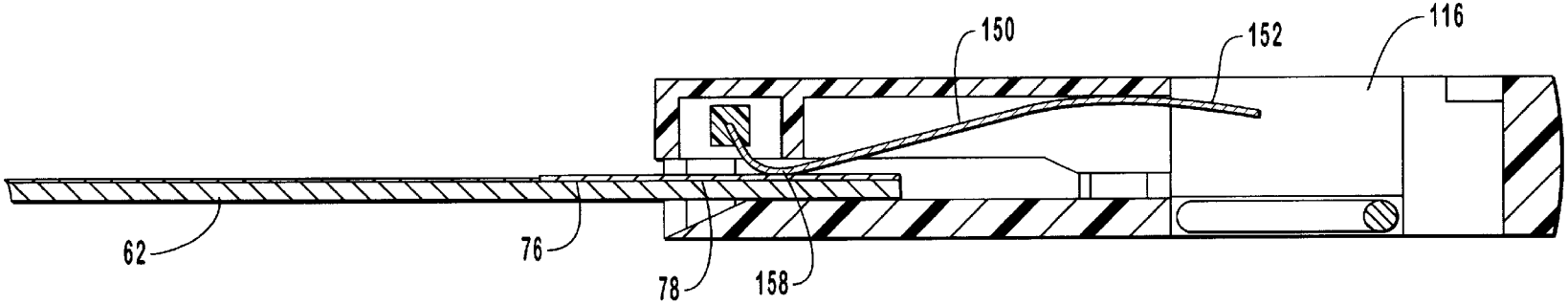
FIG. 10 is a cross sectional side view of the jack shown in FIG. 7 in an extended position.

Turning to FIGS. 9 and 10, jack 16 is configured such that when jack 16 is secured to housing 14 as discussed above, center finger 66 of PCB 62 is received within channel 132 of jack 16. In one embodiment of the present invention, means are provided for effecting electrical communication between media plug 13 and contact 76 on PCB 62 when slide plate 100 is in the extended position and media plug 13 is received within aperture 116 thereof. By way of example and not by limitation, depicted in FIG. 9, jack 16 is in the retracted position. In this position, downwardly curved portion 158 of pin 150 is positioned over covered portion 80 of contact 76. As a result, contact pin 150 is insulated from electrical communication with contact 76. Also in this position, distal end 58 of center finger 66 is vertically aligned within aperture 116. This is enabled since in the retracted position, plug 13 is not received within aperture 116.

Depicted in FIG. 10, jack 16 is in the extended position. In this configuration, downwardly curved portion 158 of pin 150 is biased against exposed portion 78 of contact 76 such that pin 150 is in electrical communication with contact 76. Similarly, depending on the configuration and intended use, other pins 150 can be biased against corresponding contacts formed on PCB 62. In the extended position, media plug 13 can be selectively received within aperture 116 such that lead end 152 of pin 150 biased against electrical contacts on media plug 13. As a result, pin 150 facilitates electrical communication between media plug 13 and contact 76 on PCB 62. Alternative embodiments of the means for effecting electrical communication are set forth in U.S. patent application Ser. No. 09/033,270, filed Mar. 2, 1998 which was previously incorporated herein by specific reference.

Although jack 16 including pin assembly 102 are shown used on housing 14, the present invention also envisions that jack 16 or elements thereof can be used in a variety of different environments. For example, PCB 62 can be formed as a portion of a primary circuit board that is securely mounted within an electrical apparatus. Jack 16 can then be directly and slidably mounted to the electrical apparatus so as to be in communication with the circuit board in the same fashion as discussed above. This embodiments eliminates the need for housing 14. Based on the teachings set forth herein, it is appreciated that jack 16 or components thereof can be used to replace existing retractable slide plates that currently incorporate the use of a flexible wire ribbon.

The inventive assemble have numerous advantages over the prior art. For example, as a result of pin 150 being in electrical communication with contact 76 by biased rather than fixed engagement, jack 16 can be selectively removed and reattached to housing 14 or other comparable structure without damaging the electrical connection. Furthermore, as a result of the shape, length, and the fact that only the tail end 154 of pins 150 are fixed, if at all, pins 150 are effective in minimizing localized stresses due to insertion and removal of media block 13. Furthermore, since inventive pins 150 produce a relatively long moment arm, lead end 152 of each pin 150 can be resiliently bent by the insertion of media plug 13 without the threat of bending pins 150 beyond their elastic point.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An electrical coupling system for use with a media plug, the coupling system comprising:

(a) a fixed member having a contact formed thereon, the fixed member extending to a free end;

(b) a slide plate having an aperture configured to receive at least a portion of the media plug, the slide plate being selectively movable relative to the fixed member between an extended position and a retracted position, the free end of the fixed member being vertically aligned with the aperture when the slide plate is horizontally disposed in the retracted position; and (c) means for effecting electrical communication between the media plug and the contact on the fixed member when the slide plate is in the extended position and the media plug is received within the aperture thereof.

2. An electrical coupling system as recited in claim 1, wherein the fixed member comprises a PCB.

3. An electrical coupling system as recited in claim 1, wherein the slide plate has a channel formed therein, at least a portion of the fixed member being disposed within the channel.

4. An electrical coupling system as recited in claim 3, further comprising a pin block disposed over the channel, the pin block having a plurality of slots separate by insulating walls, the slots facing the channels.

5. An electrical coupling system as recited in claim 1, wherein the means for effecting electrical communication comprises a pin having a lead end disposed within the aperture and a portion slidably biased against the contact on the fixed member when the slide plate is in the extended position.

6. An electrical coupling system for use with a media plug, the coupling system comprising:

(a) a PCB having a contact formed thereon;

(b) a slide plate having an aperture configured to receive at least a portion of the media plug and a channel having at least a portion of the PCB received therein, the slide plate being selectively movable relative to the PCB between an extended position and a retracted position; and (c) means for effecting electrical communication between the media plug and the contact on the PCB when the slide plate is in the extended position and the media plug is received within the aperture thereof.

7. An electrical coupling system as recited in claim 6, wherein the channel intersects the aperture.

8. An electrical coupling system as recited in claim 6, wherein at least a portion of the channel is enclosed by a pin block mounted on the slide plate.

9. An electrical coupling system as recited in claim 6, wherein the means for effecting electrical communication comprises a resiliently flexible pin having a lead end disposed within the aperture and a portion biased against the contact when the slide plate is in the extended position.

10. An electrical coupling system as recited in claim 9, further comprising:

(a) a plurality of pins each having a tail end coupled with a yoke block having opposing ends;

(b) a pin block disposed over at least a portion of the channel, the pin block having apertures formed on the opposing sides thereof, the opposing ends of the yoke block being disposed with the apertures.

11. An electrical coupling system as recited in claim 10, further comprising means for preventing annular rotation of the tail end of the plurality of pins relative to the pin block.

12. An electrical coupling system for use with a media plug, the coupling system comprising:

(a) a fixed member having a contact formed thereon;

(b) a slide plate having an aperture configured to receive at least a portion of the media plug, the slide plate having a channel formed thereon in alignment with the aperture, at least a portion of the fixed member being disposed within the channel, the slide plate being selectively movable relative to the fixed member between an extended position and a retracted position; and (c) a resiliently flexible pin having a lead end disposed within the aperture and a portion slideably biased against the contact on the fixed member when the slide plate is in the extended position.

13. An electrical coupling system as recited in claim 12, further comprising:

(a) a plurality of pins each having a second end coupled with a yoke block having opposing ends;

(b) a pin block disposed over at least a portion of the channel, the pin block having apertures formed on the opposing sides thereof, the opposing ends of the yoke block being disposed within the apertures.

14. An electrical coupling system as recited in claim 12, wherein the pin has a length extending between opposing ends in a range between about 17 mm to about 22 mm.

15. An electrical coupling system as recited in claim 12, wherein the pin has a substantially S-shaped configuration with a downwardly curved portion being biased against the contact on the fixed member.

16. An electrical coupling system as recited in claim 12, further comprising means for preventing the passage of the media plug completely through the aperture.

17. An electrical coupling system as recited in claim 12, wherein the aperture extends through the slide plate at an orientation perpendicular to the horizontal plane of the slide plate.

18. A jack for electrical coupling with a media plug, the jack comprising:

(a) a slide plate having an aperture formed thereon and a channel communicating with the aperture, the aperture being configured to receive the media plug;

(b) a pin block at least partially covering the channel, (c)an elongated yoke block having opposing ends, the yoke block being mounted on the pin block; and (d) a pin having a lead end freely disposed within the aperture and an opposing tail end connected to the yoke block.

19. A jack as recited in claim 18, wherein the pin has a substantially S-shape configuration.

20. A jack as recited in claim 18, wherein the pin block has apertures disposed on opposing sides thereof, the ends of the yoke block being removably received within the apertures.

21. A jack as recited in claim 18, further comprising a plurality of pins each having a tail end connected to the yoke block, the pin block having a plurality of elongated slots formed therein with each slot being separated by an insulating wall, each of the plurality of pins being a least partially disposed within a corresponding slot.

22. A jack as recited in claim 18, wherein a portion of the tail end of the pin is biased against the pin block so as to prevent rotation of the pin relative to the pin block when the media plug is received within the aperture.

23. A jack as recited in claim 18, further comprising means for releasably securing the media plug within the aperture.

* * * * *